United States Patent [19]

Negishi et al.

[11] 4,070,815

[45] Jan. 31, 1978

[54] TEXTURED MULTIFILAMENT YARN

[75] Inventors: Takao Negishi; Kazuo Tomiita, both of Otsu, Japan

[73] Assignee: Toray Industries, Inc., Tokyo, Japan

[21] Appl. No.: 635,230

[22] Filed: Nov. 25, 1975

[30] Foreign Application Priority Data

| | | |
|---|---|---|
| Nov. 28, 1974 | Japan | 49-135886 |
| Dec. 5, 1974 | Japan | 49-138844 |

[51] Int. Cl.[2] ..... D02G 1/16; D02G 3/24; D02G 3/34

[52] U.S. Cl. ..... 57/140 J; 28/252; 28/274; 28/276; 57/157 F

[58] Field of Search ..... 57/140 J, 157 F, 140 R, 57/140 BY, 157 R, 34 B; 28/1.4, 72.12, 252, 274, 275, 276, 271

[56] References Cited

U.S. PATENT DOCUMENTS

| | | | |
|---|---|---|---|
| 3,417,445 | 12/1968 | Gemeinhardt et al. | 28/1.4 |
| 3,477,220 | 11/1969 | Marshall | 57/140 J |
| 3,568,426 | 3/1971 | Whitley | 57/140 J |
| 3,823,541 | 7/1974 | Buzano | 57/140 J X |
| 3,846,968 | 11/1974 | Sheehan et al. | 57/140 J |
| 3,972,174 | 8/1976 | London, Jr. et al. | 57/140 J |

*Primary Examiner*—John Petrakes

*Attorney, Agent, or Firm*—Haseltine, Lake & Waters

[57] ABSTRACT

An interlaced multifilament yarn having a balanced compactness and bulkiness, composed of compact and open portions alternately appearing along its length, said compact portions having a fairly uniform configuration of interlacement. The yarn is prepared by bringing a running bundle of filaments in contact with two bending members for bending the thread-line so as to fix the thread-line between them and air jet interlacing the filaments as they pass between the bending members while forming such a stabilized thread-line.

5 Claims, 33 Drawing Figures

TEXTURED MULTIFILAMENT YARN

FIELD OF THE INVENTION

The present invention relates to a textured yarn in which multifilaments constituting the yarn are interlaced, and to a process and apparatus for producing such a textured yarn.

BACKGROUND

Techniques for imparting compactness to especially a multifilament yarn, in which the yarn is subjected to the action of turbulent fluid, have heretofore been well-known. Among others, Japanese examined patent publications Nos. 36-12230, 37-11752, discloses a non-bulky textured yarn, provided with an interlaced configuration made by treating a multifilament yarn composed of a plurality of straight individual filaments in a stream of air jet fluid. Further Japanese examined Patent Publication No. 48-33424 discloses a textured yarn, having crimps intermittently along its length, which can be prepared by treating a crimped yarn with an air jet. A process in which two false twisted yarns having opposite torques are alined and subjected to the action of turbulent fluid to produce a single yarn is disclosed in Japanese examined Patent Publication No. 49-1266. Japanese examined Patent Publication No. 49-26094 discloses an intermittently compacted textured yarn obtained by the air jet treatment of a false twisted yarn. An air jet treatment on a draw-false-twisting machine is disclosed in Japanese Laid-open Patent Application No. 48-82148. In Japanese Laid-open Patent Application No. 49-2951 there is disclosed a process for producing an intermittently compacted textured yarn in which a false twisted yarn is subjected to the action of turbulent fluid under an effective driving system.

However, these techniques involve various problems which have not been solved. While the processability of the yarn may be enhanced by imparting compactness or cohesiveness to the yarn by interlacing individual filaments in the yarn, the bulkiness of the yarn decreases and the appearance of a fabric made from said yarn is damaged as the processability is enhanced. If a high degree of bulkiness and good appearance of the fabric should be maintained, a satisfactory processability cannot be attained. The interlaced yarn obtainable by prior art processes has compact portions which are not uniform, in that some of the compact portions in such yarn are denser than other compact portions in the same yarn. When such a yarn is passed through a weaving or knitting process and the preparatory steps for such a process, the interlacement of filaments may be released in some compact portions of the yarn while other compact portions retain the interlacement of filaments, leading to a poor appearance of the resultant fabric. Furthermore, since various compact portions of different degrees of compactness are formed, excessive air jetting is required to achieve the required degree of compactness for the whole yarn, which tends to render the yarn as a whole excessively denser.

SUMMARY OF THE INVENTION

An object of the invention is to eliminate or reduce the above mentioned drawbacks of the prior art, thereby to provide improved textured multifilament yarns which are substantially free from undersirably long open portions and have processability to weaving or knitting processes better than that obtainable by twisting or sizing and, also, have a good bulkiness in the final form of a fabric.

Another object of the invention is to provide a process and apparatus for the commercial and efficient production of such improved textured multifilament yarns.

In accordance with one aspect of the invention there is provided a multifilament yarn comprising a bundle of filaments, said yarn being composed of compact portions where the filaments are interlaced and open portions where the filaments are not substantially interlaced, said compact and open portions appearing alternately along the length of said yarn, characterized in that each of at least 50% of the compact portions in said yarn has such a configuration of interlacement that the interlacement of filaments in said compact portion can be released when said compact portion is subjected to an interlacement releasing action together with the compact portions next to said compact portion without being affected by the behavior of the remaining compact portions.

For the production of the textured multi-filament yarns a running bundle of filaments is brought in contact with two curved surfaces spaced apart from each other so that the thread-line is bent at each point of contact, thereby to substantially fix the thread-line between said surfaces and to maintain a predetermined tension in said bundle of filaments, and wherein at least one fluid jet is applied to the bundle of filaments as it passes between said surfaces, so as to interlace the filaments. And in the above-mentioned process, the bundle of filaments being processed is balooned by the fluid jet so that it takes a general form like a single spindle between the above-mentioned curved members.

An apparatus is provided for the production of textured multifilament yarns, which comprises an elongated hollow member defining, by the inner surface of its wall, a yarn passage which has a cross-sectional shape having at least two lines of symmetry and extends along the longitudinal axis of said hollow member, said elongated hollow member being provided with at least one fluid inlet passage extending in a plane perpendicular to the longitudinal axis of said yarn passage and through the wall of said hollow member with one end opened to said yarn passage and with the other end communicated with a source of fluid under high pressure, and a pair of bending members respectively located upstream and downstream of said fluid inlet passage for bending the thread-line of the yarn being processed, said fluid inlet passage being located so that the central line of said inlet passage will intersect the thread-line of the yarn being processed and will coincide with one of the lines of symmetry of the cross-sectional shape of the yarn passage.

A textured multifilament yarn in accordance with the invention is composed of compact and open portions alternately appearing along the length of the yarn. At least 50% of the compact portions must have such a configuration of interlacement that the interlacement of filaments in said compact portion can be released when said compact portion is subjected to an interlacement releasing action together with compact portions next to said compact portion without being affected by the behavior of the remaining compact portions.

In order to determine whether a particular compact portion in a given yarn sample meets the requirement set forth above, the following test may be convenient. Two needles are respectively pierced into two open portions in the yarn sample so that between said two pierced open portions there are located the compact portion to be tested, two open portions adjacent to said compact portion to be tested and two other compact portions adjacent to the non-pierced open portions. The yarn sample with the needles pierced thereinto in a direction perpendicular to its length is then intermittently pulled by hand to try to release the interlacement of filaments in the compact portion to be tested. The opening of filaments in the compact portions may be manually assisted using a suitable needle. Observation is then made whether or not the filaments in the tested compact portion have been successfully opened. In some cases the interlacement of filaments is released over the entire length of the yarn between the needles. In other cases, the interlacement of filaments remains partially or wholely unreleased in one or both compact portions next to the tested compact portion, while the filaments in the tested compact portion have been opened. In still other cases the interlacement of filaments remains unreleased in the tested compact portion. Only in the last mentioned cases, is the tested compact portion judged to not satisfy the above-defined requirement. The test may conveniently be carried out on each of one hundred compact portions chosen at random from the length of 100 m of the yarn sample. The number of compact portions which do not pass the above-mentioned test should be, in accordance with the invention, less than 50 per 100 tested compact portions. It will be understood that the needles pierced into the yarn act as bars which during the test effectively protect the three compact portions between the needles from being affected by the behavior of interlaced filaments in the remaining compact portions under tension.

In preferred multifilament yarns in accordance with the invention, the configuration of interlacement is fairly uniform along the length of yarn. In other words, at least 50% of compact portions in the yarn have the same or similar interlacement configuration.

Thus, in a first preferred embodiment according to the invention, each of at least 50% of the compact portions in the yarn has such a configuration of interlacement that the interlacement of filaments in said compact portion can be released within said portion. By the expression the interlacement of filaments in said compact portion can be released "WITHIN SAID PORTION", we mean that when said compact portion is subjected to an interlacement releasing action without being affected by the behavior of interlaced filaments in other compact portions of the yarn, the interlacement in said portion can be released. This type of interlacement configuration may be referred to as interlacement configuration I and will be described in detail hereinafter with reference to FIG. 3 and in Example 2.

In a second preferred embodiment according to the invention, each of at least 50% of the compact portions in the yarn has such a configuration of interlacement that, while the interlacement of filaments in said compact portion cannot be released within said portion, it can be released together will all or a part of the interlacement of filaments in one compact portion next to said compact portion. This type of interlacement configuration may be referred to as interlacement configuration II and will be described in detail hereinafter with reference to FIG. 4 and in Example 1.

In a third preferred embodiment according to the invention, each of at least 50% of the compact portions in the yarn has such a configuration of interlacement that, while the interlacement of filaments in said compact portion cannot be released within said portion, a part of the interlacement of filaments in said compact portion can be released together with all or a part of the interlacement of filaments in one compact portion next to said compact portion and the remaining part of the interlacement of filaments in said compact portion can be released together with all or a part of the interlacement of filaments in the other compact portion next to said compact portion. This type of interlacement configuration may be referred to as interlacement configuration III and will be described in detail hereinafter with reference to FIG. 5 and in Example 3.

While the key step in the process for producing the textured multifilament yarns, as hereinbefore defined, is the treatment of a running bundle of filaments with one or more interlacing air jets, we have found that the textured multifilament yarns disclosed and claimed herein cannot be produced by the known processes.

We have also found that when a running bundle of filaments crosses a direction of an air jet, the filaments in that portion of the bundle where the air jet is directed are opened and disturbed, and the filaments are interlaced upstream and downstream of said portion. In the practice of the known processes, while the filaments in the running bundle are disturbed and caused to vibrate in the treatment zone, the movement of filaments wherein the filaments cross a direction of the air jet does not occur frequently, rendering the interlacing efficiency of such processes significantly lower.

We have prepared the textured multifilament yarns having the configurations of interlacement as described herein by a process wherein a running bundle of filaments is brought in contact with two curved surfaces spaced apart from each other so that the thread-line is bent at each point of contact, thereby to substantially fix the thread-line of the running bundle of filaments between said surfaces and to maintain a predetermined tension in said bundle of filaments; and wherein at least one fluid jet is applied to the bundle of filaments as it passes between said surfaces so as to interlace the filaments.

The essential feature of the process resides in the fact that a running bundle of filaments is brought in contact with two curved surfaces spaced apart from each other so that the thread-line of the running bundle is bent at each point of contact. This allows the thread-line of the running bundle of filaments to be stabilized between the two curved surfaces. In the process at least one fluid jet is applied to the bundle of filaments as it passes between the two curved surfaces forming such a stabilized thread-line. With respect to process conditions and apparatus requirements other than the above, those used in the known processes may be used except for a tension. In carrying out the process it is preferred to use a relatively high tension, for example, varying within the range of 2 to 28 g, preferably 5 to 8 g, depending on other conditions, such as the nature of the particular filament to be processed, the number of the filaments and the processing rate.

It is desirable to select conditions so that the bundle of filaments being processed may form a general form like a single spindle between the two curved surfaces.

Due to the uniform configuration of interlacement, the textured multifilament yarns according to the invention have a uniform degree of compactness. Since the interlacing operation can be stably carried out, an excessive treatment can be avoided, and the products of the invention are substantially free from undersirably long open portions. Thus, the products of the invention have a desired combination of processability and bulkiness. They can readily be unwound from a yarn package without fail, and easily be handled manually. Furthermore, because of their improved resistance to pilling and snagging, they do not suffer from breakage of single filaments and, thus, they may safely be passed through a weaving or knitting process and the preparing steps for such a process.

DETAILED DESCRIPTION

In a bundle of filaments composing a multifilament yarn, the filaments are arranged parallel to each other and the arrangement of the filaments may not be changed where the bundle of filaments is deformed. When a bundle of filaments is subjected to the action of turbulent fluid, the fluid acts on the individual filaments and the filaments are thus interlaced. However, in certain portions of the bundle there exist an interlacement of filaments which is releasable within said certain portions and an interlacement of filaments which is unreleasable within said certain portions, and an interlacement of filaments which is exactly opposite to, i.e. can be offset by, said unreleasable interlacement is formed outside said certain portions, in many cases in the vicinity thereof. Between a portion having one type of interlacement configuration and another portion having another type of interlacement configuration, there is often a portion where the filaments are not substantially interlaced and, therefore, the interlaced compact portions often appear apparently intermittently in a bundle of filaments.

In a bundle of filaments having intermittently interlaced compact portions, the compactness of bundle and the retainability of interlacement are largely related to the configuration of interlacement in the individual interlaced portions and are affected more effectively by the configuration of interlacement than by the frequency of interlacement.

Figure 1:
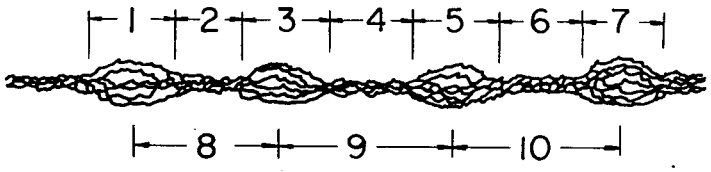
FIG. 1 is a schematic perspective view of interlaced multifilament yarn.

When a bundle composed of filaments is subjected to an interlacing treatment whereby the filaments are interlaced, as schematically shown in FIG. 1, open portions 1, 3, 5 and 7 and compact portions 2, 4 and 6 are formed alternately and successively along the length of the bundle, particularly in the case where the filaments have crimp. Although it is difficult to definitely determine the border of a compact portion and an open portion adjacent to said compact portion, if the configuration of interlacement in the compact portions is to be discussed, it may be sufficient to discuss the configuration of interlacement in interlaced portions separated at the middle of the open portions, as designated by 8, 9 and 10 in FIG. 1.

In FIGS. 2, 3, 4 and 5, open portions are designated by circles and compact portions are designated by lines joining two adjacent circles and, thus, the term "interlaced portions" refers to the portions between two adjacent circles. In these figures, each of the letters A through O designates a type of interlacement configuration and the same letters with a minus sign designate an exactly opposite interlacement configuration; for example −A designates an interlacement configuration exactly opposite the interlacement configuration designated by A.

In a bundle of filaments interlaced as mentioned above, it is very rare that a configuration of interlacement having the exactly same arrangement of filaments as that of an interlacement configuration appearing in one portion of the bundle will appear again in another portion of the bundle. Accordingly, in the description given below, with reference to FIGS. 2, 3, 4 and 5, the arrangement of filaments in the interlacement configuration will not be discussed, but the arrangements of the interlacement configuration along the length of the bundle, of the interlacement configuration within interlaced portions and of the interlaced portions will be discussed.

An interlaced multifilament yarn produced by a conventional interlacing fluid jet treatment has various types of interlacement configurations arranged along the yarn length. However, multifilament yarns having the following three types of interlacement configurations can be obtained by a controlled interlacing treatment according to the invention.

INTERLACEMENT CONFIGURATION I

Figure 2:
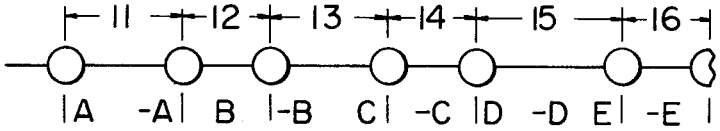
FIG. 2 is a diagramatical representative view of a configuration of an interlaced multifilament yarn according to the invention.

In this configuration, the interlacement of filaments can be released within a single interlaced portion as is the case in the interlaced portion 11 in FIG. 2.

INTERLACEMENT CONFIGURATION II

In this configuration, although the interlacement of filaments can not be released within a single interlaced portion, it can be released together with the interlacement in one interlaced portion next to said single interlaced portion while it can not be released together with the interlacement in the other interlaced portion next to said single interlaced portion, as is the case in the interlaced portions 12, 14, 15 and 16 in FIG. 2. For example, although the interlacement in the interlaced portion 12 can not be released alone, it can be released together with the interlacement in the interlaced portion 13 while it can not be released together with the interlacement in the interlaced portion 11.

INTERLACEMENT CONFIGURATION III

In this configuration, the interlacement can not be released within a single interlaced portion and it can not be released together with the interlacement in either one interlaced portion next to said single interlaced portion, however it can be released together with the interlacement in both interlaced portions next to said single interlaced portion. That is, the interlacement in the interlaced portion 13 can not be released together with the interlacement in the interlaced portion 12 or 14 but it can be released together with the interlacement in the interlaced portions 12 and 14.

Figure 3:
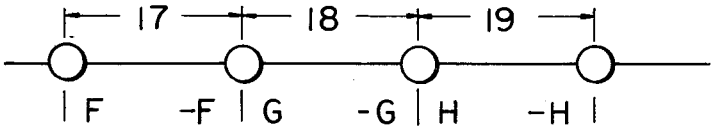
FIGS. 3, 4 and 5 are diagramatical representative views of three different configurations of the interlaced multifilament yarns according to the present invention.
Figure 4:
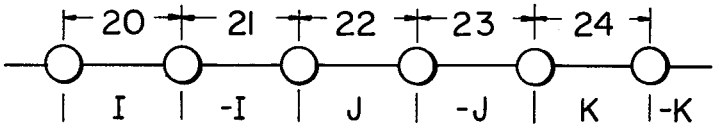
Figure 5:
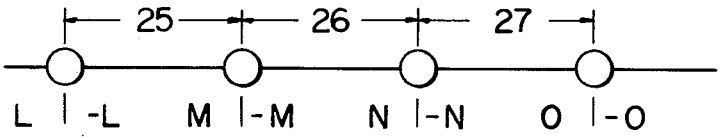

The configurations of interlacement as schematically shown in FIGS. 3, 4 and 5 correspond, respectively, to the above-mentioned interlacement configurations I, II and III.

The interlaced multifilament yarn having the interlacement configuration as mentioned above has been proved to have the following characteristics: an overall good processability in weaving and knitting processes, and; a good bulkiness in the final form of a fabric. These characteristics are due to the fact that the interlacement configuration and the compactness are fairly uniform along the yarn length.

The process and apparatus for the production of the above mentioned interlaced multifilament yarns according to the invention will be hereinafter described.

As hereinbefore mentioned, the interlaced multifilament yarn according to the invention is produced by a controlled interlacing treatment by means of a known type interlacing apparatus with fluid jets whereon a fluid jet nozzle having a specific construction as hereinafter described in detail and specifically arranged bending members for substantially fixing the thread-line are provided.

In order to effectuate the controlled interlacing treatment by a turbulent fluid, it is desirable to satify at least the following three conditions. That is, firstly, the fulcra of the vibration of the processing yarn should be definitely determined and the distance between the fulcra should be shortened in order to stabilize the vibration of the yarn in the interlacing zone. Secondly, the tension of the processing yarn should be increased in order to stabilize the vibration of the yarn. Thirdly, satisfactory interlacement should be imparted by an interlacing fluid jet action at one point. We have found that these conditions can be satisfied by a process for the production of textured multifilament yarns wherein a running bundle of filaments is brought in contact with two curved surfaces spaced apart from each other so that the thread-line is bent at each point of contact, thereby to substantially fix the thread-line between said surfaces and to maintain a predetermined tension in said bundle of filaments; and wherein at least one fluid jet is applied to the bundle of filaments as it passed between said surfaces, so as to interlace the filaments.

Figure 6:
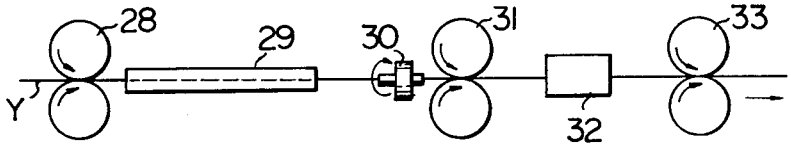
FIG. 6 is a schematic elevation of an interlacing treating apparatus connected to a conventional false twisting apparatus at a downstream position of the false twisting apparatus according to the present invention.

The above-mentioned interlacing treatment is practically carried out as hereinafter explained in detail. In the embodiment shown in FIG. 6, a multifilament yarn Y is false twisted in a yarn passage between a yarn feeding device 28 and a yarn feeding device 31 so that the individual filaments of the multifilament yarn Y are provided with crimps by the action of a false twisting device 30. If the yarn Y is an undrawn yarn, the drawing of the filaments of the yarn may be simultaneously applied before or during the above-mentioned false twisting operation. The interlacing treatment is applied to the false twisted yarn delivered from the yarn feeding device 31 while the false-twisted yarn is carried to a feeding device 33, by means of a fluid-interlacing device 32 disposed between the feeding devices 31 and 33. The interlacing device 32 is provided with a pipe member which provides a yarn passage therethrough and the thread-line of the yarn Y is bended at the two ends of the pipe member is contacting condition of the yarn Y with the two ends of the pipe member, as hereinafter explained in detail. The contacting points of the yarn Y with the two ends of the piper member work as a pair of fulcra of the vibration of the yarn Y along the thread-line in the pipe member, and the distance between the above-mentioned two contacting points may be reduced by utilizing a fluid-interlacing device 32 of small size. In this embodiment, a pair of fluid-jet inlets are symetrically disposed to the pipe member 32 in facing condition in such a way that the central axis of the inlets are perpendicularly directed to the straight yarn passage in the pipe member.

Since the above-mentioned straight yarn passage is definitely formed by the above-mentioned two contacting points, the thread-line of the yarn is stably fixed. Consequently, the interlacing treatment can be carried out in a very controlled condition. Through experience we have confirmed that the interlacing treatment of the yarn Y can be carried out, in such a condition that the yarn vibration is maintained in very stable condition, under such a yarn tension, for example between 2g and 28g/150d, more preferably between 5 g and 8 g/150d. Under the above-mentioned condition, a very uniform interlacing treatment can be applied to the yarn Y.

As to the fluid interlacing device applied to the present invention, a device similar to the conventional fluid interlacing device can be utilized. That is, in the fluid interlacing device utilized for the present invention, at least one jet fluid stream is introduced into the chamber of the pipe-member by way of the respective fluid inlet passages formed in the shell of the pipe member and the fluid introduced into the chamber is discharged from an end or ends of the pipe member.

Figure 7:
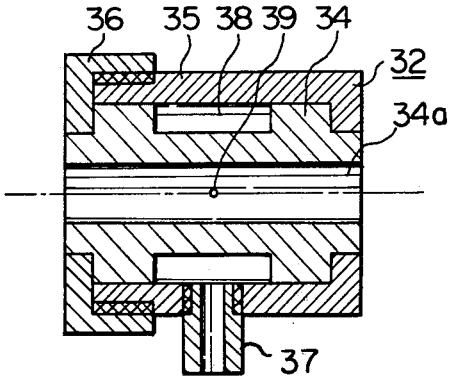
FIG. 7 is an axial cross-sectional view of an interlacing air jet device according to the present invention.

In an embodiment of the fluid interlacing device 32, which is shown in FIG. 7, the pipe member 34 is inserted into a cylindrical body 35 and rigidly held by a flange member 36. A supply conduit 37 is disposed to the cylindrical body 35 for supplying a fluid of high pressure into the pipe member 34. A ring shaped recess 38 is formed on the outside peripheral surface of the pipe member 34 and the supply conduit 37 is connected to a ring shaped space formed between the recess 38 and the inside cylindrical wall of the cylindrical body 35. Therefore the above-mentioned ring shaped space forms a chamber filled with high pressure fluid. A fluid inlet passage 39 is formed in the shell of the pipe body at a position where the fluid inlet passage 39 connects the above-mentioned ring shaped space with an inside space 34*a* of the pipe member 34. Consequently, the compressed fluid is jetted into the inside space 34*a* of the pipe member 34 and thereafter discharged outside from the two opened ends of the pipe member 34. The material yarn is passed through the inside space 34*a* in such a way that the yarn passage is folded at a portion of one open end of the pipe member 34 and also folded at a portion of the other opened end of the pipe member 34. That is, the above-mentioned two portions, where the yarn passage is folded, are positioned on opposite sides of the longitudinal central axis of the pipe member 34. Instead of applying the above-mentioned bent thread-line formed in the pipe member 34, it is also useful to dispose a guide member at a position outside each of the two ends of the pipe member 34 so as to form the bent thread-line defined by the above-mentioned guide members.

In this case, the thread-line may be bent toward the identical side at the contacting positions of the respective guide members, with respect to the thread line in the pipe member 34.

Figure 8:
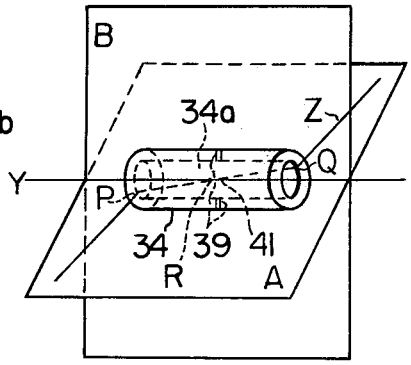
FIG. 8 is a diagramatical view for illustrating the relation between the thread-line and the interlacing device shown in FIG. 7.

The above-mentioned fluid interlacing device of the present invention is hereafter explained in more detail. In the device shown in FIG. 8, the pipe member 34 is provided with the inside space 34*a* having an arcuate, circular or rectangular lateral cross section. It is not essential to have a uniform lateral cross section along the inside space 34*a*. However, as shown in FIG. 8, it is preferable to have such a uniform lateral cross section.

As to the guide members forming the pair of bending points P, Q of the thread-line, such an element as a roller or yarn guide can be satisfactorily utilized. However, it is required that the above-mentioned points P, Q satisfy the following three conditions. The first condition is that the points P and Q are positioned on a plane A whereon the longitudinal axis of the pipe member 34 is positioned. The second condition is that the points P and Q are located on the plane A at opposite sides of the above-mentioned longitudinal axis of the pipe member 34. The third condition is that, if a thread-line having the shortest course Z is formed in such a condition that the yarn passage passes the points P, Q and passes through the pipe member 34, and if the positions of these points P and Q are changed, the thread-line in the pipe member 34 is maintained at the same position as the previous one.

In the above-mentioned condition of the pipe member 34, the circular lateral cross-section of the inside space 34*a* of the pipe member 34 along the longitudinal axis thereof is uniform. However, if the shape of the lateral cross-section is polygonal or the laterial cross-section of the inside space 34*a* of the pipe member 34 along the longitudinal axis thereof is not uniform, the position of the above-mentioned plane A is defined in such condition that the pipe member 34 can be divided into four symmetrical elements along the lengthwise axis thereof by the plane A and a plane B which crosses the plane A along the above-mentioned lengthwise axis. Therefore, the above-mentioned lengthwise axis coincides with a crossing line Y of the planes A and B.

To determine the disposition of the fluid inlet passage 39 which pass through the shell of the pipe member 34, the above-mentioned definition of the shortest course Z of the thread-line and the crossing line Y of the planes A and B are used as hereinafter explained. That is, the pair of fluid inlet passages 39 must be arranged in such a way that the lengthwise axis of these fluid inlet passages 39 are positioned on a straight line which passes a crossing point of the line Y and the line Z. The lateral cross-section of these inlet passages 39 is circular, but other shapes such as square, rectangular and other polygonal shapes can be applied.

Figure 9:
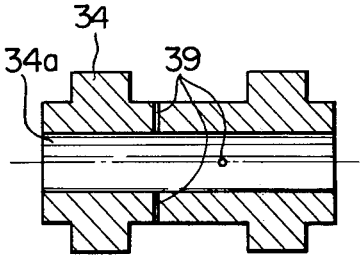
FIG. 9 is an axial cross-sectional view of a conventional interlacing device.

To clarify the function of the above-mentioned interlacing device in comparison with the conventional one, an example of the pipe member of the conventional interlacing device is shown in FIG. 9. This pipe member 34 is provided with two pairs of the fluid inlet passages 39 arranged in such a way that the two passages of a pair of the passages 39 face each other and are directed to the longitudinal axis of the inside space 34*a* along a common straight line which crosses the above-mentioned longitudinal axis. However the above-mentioned common straight lines of the two pairs of fluid inlet passages 39 cross the longitudinal axis of the inside space 34*a* at two different crossing points and the relation between the direction of these two common straight lines is perpendicular with respect to the longitudinal axis of the inside space 34*a*. According to our experimental tests, the yarn frequently passes through the inside space 34*a* along a passage adjacent to the inside wall of the pipe member 34 and therefore, such yarn passed through the above-mentioned particular passage can not be effectively interlaced.

Contrary to the case of the above-mentioned conventional pipe member 34, in the interlacing device according to the present invention, since the thread-line in the inside space 34*a* is defined by the two open of the pipe member 34 or the bending guide members disposed outside the pipe member 34, even if the yarn deviates from the above-mentioned fixed passage, the yarn soon returns to the fixed passage due to the action of the yarn tension. Consequently, there is only a relatively short portion of yarn which is not effectively interlaced.

Figure 10:
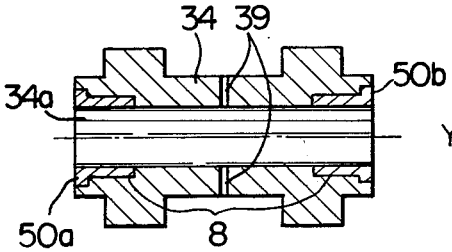
FIG. 10 is an axial cross-sectional view of another embodiment of the interlacing device according to the present invention.

The pipe member 34 is shown in FIG. 10 is provided with a pair of fluid inlet passages 39 directed to a common point on the longitudinal axis of the inside space 34*a*. This type of pipe member is also used for the conventional fluid interlacing device. However, it is important to realize that, in the present invention, the thread-line in the pipe member 34 must be fixed. To satisfy this requirement, a pair of ring shaped bushes 50*a* and 50*b* are rigidly inserted into the space 34*a* at the two open ends thereof. These bushes 50*a*, 50*b* are made from a material having strong wear-resistance. Therefore, the yarn passage in the space 34*a* can be effectively defined by the above-mentioned bushes 50*a*, 50*b* if the pipe member 34 is utilized as shown in FIG. 8.

Figure 11:
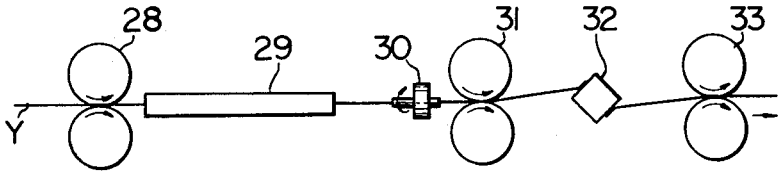
FIG. 11 is a schematic elevation of another embodiment of the interlacing treating apparatus connected to a conventional false twisting apparatus in the same condition as the apparatus shown in FIG. 6, according to the present invention.

In the above-mentioned embodiment of the fluid interlacing device 32, the fluid introduced into the inside space 34*a* of the pipe member 34 is discharged toward a direction which deviates from the yarn passage outside the pipe member 34. Consequently, such a interlacing device 32 is easily arranged in the conventional textile machine, such as a drawing machine, a false twisting machine, etc., in such a condition that the discharged fluid does not have any unexpected influence on the processing yarn of these textile machine. An example of the application of the fluid interlacing treating device 32 of the present invention to the false twisting apparatus at the downstream position thereof is shown in FIG. 11.

Figure 12:
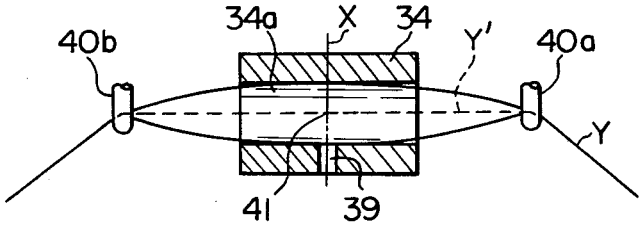
FIG. 12 is a schematic elevation of still other embodiment of the interlacing device, partly in section, according to the present invention.

In the embodiment shown in FIG. 12, a pair of yarn guide members 40*a*, 40*b* are disposed at respective positions outside the pipe member 34 in such a condition that the bent yarn passage is defined by the guide members 40*a* and 40*b*. The yarn Y passes through the inside space 34*a* of the pipe member 34 and the direction of the yarn passage is changed by the yarn guide members 40*a* and 40*b*. An imaginary yarn passage Y', which passes along the longitudinal axis of the inside space 34*a*, crosses a longitudinal axis X of the fluid inlet passage 39 at a point 41. The distance between the point 41 and the respective yarn guides 40*a*, 40*b* are identical. In this embodiment, the multifilament yarn Y vibrates in the space defined by the yarn guides 40*a* and 40*b* in such a condition that the yarn Y is vibrated in a spindle shaped cubic space wherein a longitudinal axis thereof coincides with the imaginary yarn passage Y'.

The shape and size of the above-mentioned fluid interlacing device may be modified. However, as mentioned above, the following three conditions must be satisfied. That is, the first condition is that the threadline of the running multifilament yarn Y crosses the longitudinal axis X of the fluid inlet conduit 39; the second condition is that the multifilament yarn Y contacts the yarn guide members 40*a*, 40*b* which are arranged at the outside positions of the pipe member 34 with an identical distance from the above-mentioned crossing point of the first condition, and the running direction of the yarn is turned at the bending points of the yarn Y with the yarn guide members 40*a* and 40*b*, and; the third condition is that the yarn Y is vibrated in the passage between the yarn guide members 40*a* and 40*b* by the action of the fluid jet from the fluid inlet passage 39 in such a condition that the above-mentioned spindle shaped vibration of the yarn Y is formed. It is important to realize that the vibration of the yarn should be controlled not to create any node in the space between the yarn guide members 40*a* and 40*b*.

Figure 13:
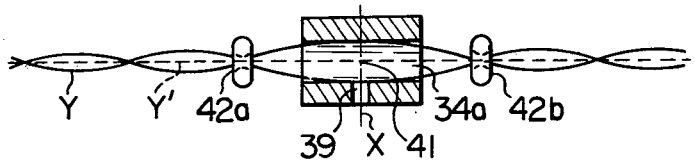
FIGS. 13, 14, 15 and 16 are schematic elevations of interlacing devices which are similar to the embodiment shown in FIG. 12, but include defective arrangement of guide members.
Figure 14:
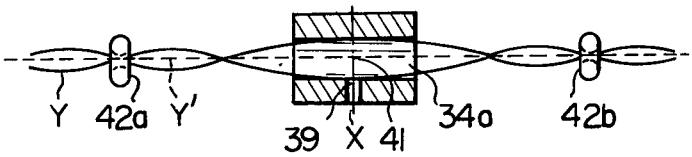

To clarify the effective creation of the interlacing of the individual filaments of the yarn according to the above-mentioned embodiment, the effect resulting from changing the yarn guide members 40*a*, 40*b* is hereinafter explained in detail. Referring to FIGS. 13 and 14, a pair of ring shaped guide members 42*a*, 42*b* are utilized instead of the yarn guide members 40*a*, 40*b*. The yarn Y passes through these ring shaped guide members 42*a*, 42*b* without changing its running direction. Since the vibration wave of the yarn Y goes beyond the outside portions of the yarn passage outside the ring shaped guides 42*a*, 42*b*, the yarn vibration of the yarn Y in the space between these two yarn guides 42*a*, 42*b* becomes insufficient to create the desirable interlacing effect. Further the yarn Y tends to pass through a passage adjacent to an inside wall of the pipe member 34 due to the action of the fluid jet from the passage 39 and consequently, insufficient interlacing action is frequently applied to the yarn Y. To prevent such drawback, the size of the open space of the ring shaped yarn guide 42*a*, 42*b* may be reduced, however, it was confirmed by us that such reduction of the open space was not effective. The above-mentioned style of utilization of the fluid interlacing device has been conventionally applied for producing the interlaced multifilament yarn.

Figure 15:
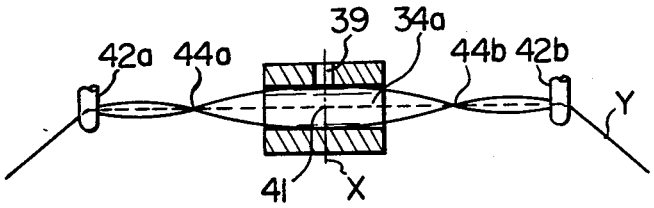
Figure 16:
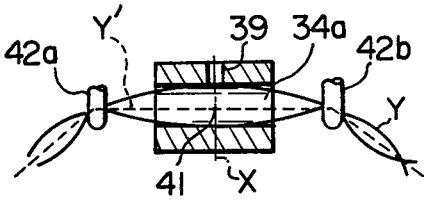

The style of the interlacing treating device shown in FIG. 15 is not practical, because even if the running direction of the yarn Y turns at the contacting points of the yarn Y with the yarn guides 42*a*, 42*b*, since a node 44*a* (44*b*) of the vibration of the yarn Y is formed at the respective outside passages between the pipe member 34 and the yarn guides 42*a*, 42*b*, there is frequency possibilities of passing the yarn along a deviated passage adjacent to the inside wall of the pipe member 34, due to the action of the fluid jet from the passage 39, without creating the desirable vibration of the yarn Y. And even through the distance between the ring shaped guide members 42*a* and 42*b* is reduced to eliminate the nodes 44*a*, 44*b*, if the yarn tension is not pertinent, the vibration of the yarn Y goes beyond the respective ring shaped yarn guides 42*a* and 42*b* as shown in FIG. 16. Such condition of yarn vibration is not desirable to attain the purpose of the present invention.

In the style of utilizing the interlacing device 32 as shown in FIG. 12, it is essential to eliminate the possible transmission of the wave of the yarn vibration going beyond the yarn guide members 42*a*, 42*b* by exactly urging the yarn Y to these members 42*a* and 42*b* so that a single spindle shaped vibration of the yarn Y is formed between the yarn guide members 42*a* and 42*b*. This condition of the yarn vibration in the fluid interlacing treatment is a very important factor in carrying out the interlacing treatment according to the present invention.

To satisfy the above-mentioned required condition, several factors concerning the interlacing treatment have to be controlled. That is, yarn tension, running speed of the yarn, condition of the fluid jet, direction of the fluid jet applied to the yarn, distance between the yarn guides where the direction of the running passage of the yarn is changed, etc., must be controlled. According to our experimental test, the type of the fluid interlacing treating which fits the material yarn Y is first decided upon and, thereafter, decisions are arrived at regarding the other factors from the point of view of satisfying the above-mentioned essential condition. Such preliminary decisions regarding the above-mentioned factors can be made without too much difficultly.

The above-mentioned factors are hereinafter explained in detail.

As to the material yarn, a multifilament yarn provided with a plurality of individual filaments and having properties which make is suitable for interlacing treatment is preferably utilized. For example, a multifilament yarn composed of a plurality of individual filaments, each individual filament having a fine thickness and not too strong a stiffness, a false twisted multifilament yarn, etc., are suitable for creating the interlaced multifilament yarn according to the present invention.

Any compressed fluid such as compressed air, heated compressed air, compressed steam, a mixture of compressed air and vapor, etc., can be utilized, however, such compressed fluid must not adversely affect the material multifilament yarn.

Suitable yarn tension is required to create the effective interlacing of the component individual filaments of the material yarn. If the yarn tension is too strong, the desirable vibration of the yarn Y can not be created.

The general structure of the fluid interlacing treating device has been hereinbefore explained. The following explanation relates to the detailed structure thereof.

Figures 17A, 17B, 17C:
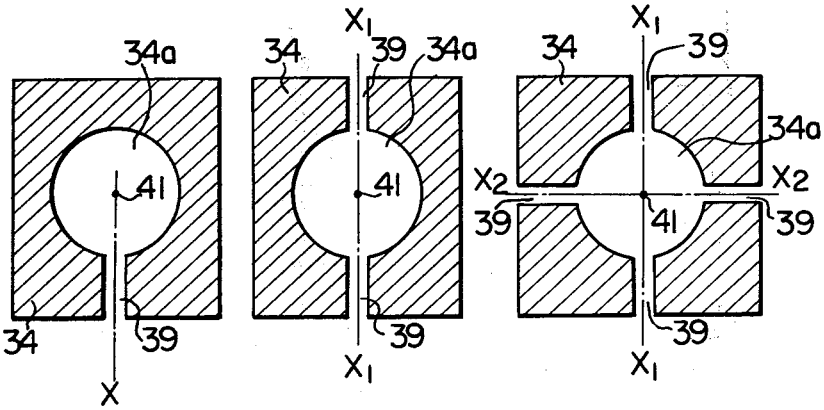
FIGS. 17A, 17B and 17C are cross-sectional views of a portion of the interlacing devices, where at least one fluid inlet passage is disposed, according to the present invention.
Figure 18A:
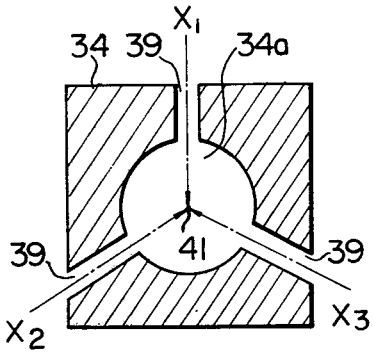
FIGS. 18A and 18B are cross-sectional views of a portion of the modified interlacing devices, where a plurality of fluid inlet passages are disposed, according to the present invention.
Figure 18B:
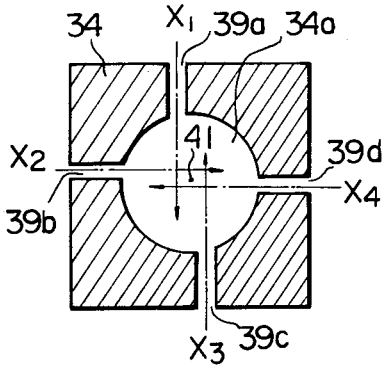
Figure 19:
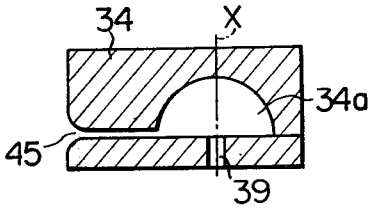
FIGS. 19, 20, 21 and 22 are cross-sectional views of a portion of the interlacing devices, where a fluid inlet passage and a slit for threading a material yarn into a yarn passage of said interlacing treating device, are disposed, according to the present invention.

As shown in FIGS. 8 and 12, the fluid inlet passage 39 is formed in the shell of the pipe member 34 in such a condition that the fluid jet from the passage 39(*s*) is applied to the yarn Y at the crossing point 41 on the thread-line Z in the pipe member 34. The working direction of the fluid jet is substantially perpendicular to the thread-line Z which is defined by the points P and Q or defined by the contacting yarn guide members 40*a*, 40*b* or 42*a*, 42*b*. It is preferable to arrange the fluid inlet passage 39 at substantially a middle position with respect to the longitudinal axis of the fluid interlacing device 32. Several types of arrangements of the passages 39, which are shown in cross-section of the pipe member 34, are shown in FIGS. 17A, 17B and 17C. Some modifications of the above-mentioned arrangement of the passage 39 are shown in FIGS. 18A and 18B, by which a similar interlacing effect to that of the embodiments shown in FIGS. 17A, 17B and 17C can be attained. The pipe member 34 shown in FIG. 18A is provided with three fluid inlet passages 39 arranged in such a condition that the fluid jets from these passages 39 meet at one position on the central axis of the inside space 34*a*. The pipe member 34 shown in FIG. 18B is provided with two pairs of fluid inlet passages 39*a*, 39*b*, 39*c* and 39*d* arranged in such a condition that the fluid jets from any pair of passages, 39*a* and 39*c*, 39*b* and 39*d*, facing each other are offset from the central axis of the inside space 34*a*. In this embodiment of FIG. 18B, the fluid jets from the passages 39*a* and 39*c* create a jet current turning counter clockwise, while the fluid jets from the passages 39*b* and 39*d* create a jet current turning clockwise and, consequently, such two turning currents are combined and eliminated so that the yarn Y is not twisted.

Several lateral cross-sectional shapes of the inside space of the pipe member 34, such as circular, arcuate, rectangular, etc., can be utilized, as already explained.

For the sake of convenience to thread the yarn Y into the pipe member 34, it is preferable to form a slit 45 as shown in FIGS. 19, 20, 21 and 22. During our experimental tests, it was confirmed that such slit 45 does not create any influence on the effect of the interlacing treatment according to the present invention. That is, in the embodiments shown in FIGS. 19, 20, 21 and 22, the fluid jet from the fluid inlet passage 39 impacts on the inside wall opposite the passage 39, and bounces back. Consequently, the multifilament yarn Y is subjected to the very effective interlacing action created by the fluid jet.

Figure 23:
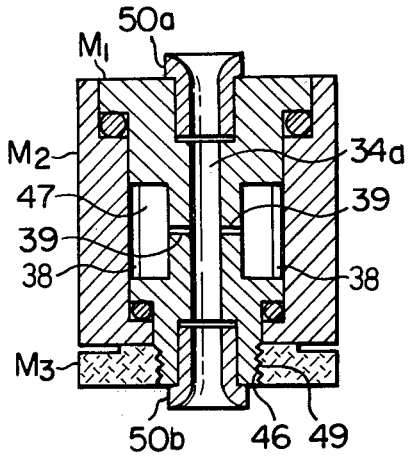
FIG. 23 is an axial cross-sectional view of an embodiment of a practical interlacing device, according to the present invention.
Figure 24:
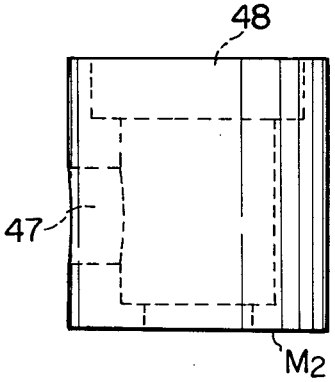
FIGS. 24, 25 and 28 are elevations of elements utilized for the interlacing device shown in FIG. 23.
Figure 25:
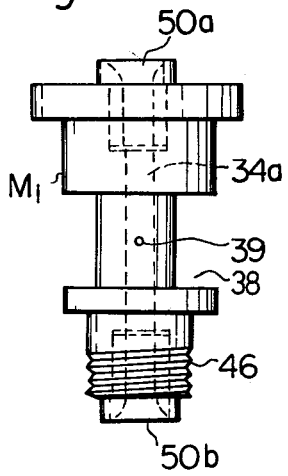
Figure 26:
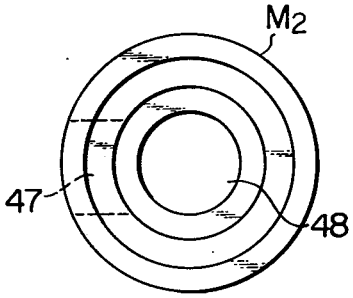
FIGS. 26, 27 and 29 are plan views of the respective elements shown in FIGS. 24, 25 and 28.
Figure 27:
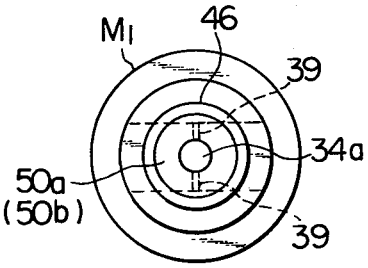
Figure 28:
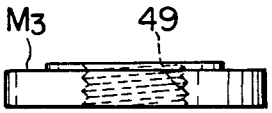
Figure 29:
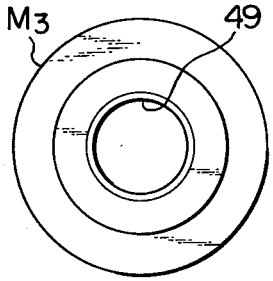

The detailed construction of an embodiment of the interlacing device according to the present invention is hereinafter explained with reference to the drawings of FIGS. 23, 24, 25, 26, 27, 28 and 29. This device comprises three parts $M_1$, $M_2$ and $M_3$. Referring to FIGS. 23 and 25, the part $M_1$ is a pipe member provided with an inside space 34*a* passing therethrough and a pair of fluid inlet passages 39 passing through the shell thereof in such a condition that the central axis of these conduits 39 pass along a common straight line which crosses the longitudinal axis of the inside space 34*a*. A ring shaped recess 38 is formed on the member $M_1$ in such a condition that the conduits 39 open to the recess 38. An end portion 46 of the part $M_1$ is threaded (FIGS. 25 and 27). The part $M_2$ is provided with a fluid supply aperture 47 and a recess 48 which is capable of holding the part $M_1$ therein, as shown in FIG. 24 and 26. The part $M_3$ is a fastening member for rigidly assembling the above-mentioned parts $M_1$ and $M_2$ as shown in FIGS. 28 and 29. For this purpose, a threaded portion 49 is formed in the part $M_3$. When these parts $M_1$, $M_2$ and $M_3$ are assembled as shown in FIG. 23, a compressed fluid supplied from a supply source (not shown) is firstly introduced into the fluid supply aperture 47 which is connected to the ring shaped recess 38, and the compressed fluid is then introduced into the inside space 34*a* via the inlet passages 39 and discharged outside of the pipe member 34 from the opended ends thereof. In this embodiment, bush members 50*a*, 50*b*, made from a material having strong resistance against wear, are rigidly inserted into the pipe member 34 at the two opened end portions thereof so that the yarn passage in the inside space 34*a* is defined by these members 50*a* and 50*b*.

As mentioned above, since the construction of these three parts $M_1$, $M_2$ and $M_3$ are simple, the fluid interlacing treatment device 32 can be easily assembled.

Next, the interlacing multifilament yarn and the method for manufacturing this yarn according to the present invention are explained in more detail with reference to several experimental examples.

EXAMPLE 1

Polyethylene terephthalate was melt spun into filaments and taken up on a drum at a rate of 3000 m/min to prepare a multifilament yarn of 250 denier/48 filaments. The multifilament yarn was then processed in a manner as illustrated in FIG. 11. That is, the yarn Y was drawn 150 denier and simultaneously false twisted, and then interlaced with a fluid at a processing rate of 400 m/min.

The textured yarn so obtained had an appearance as schematically shown in FIG. 1. Two needles were pierced into the middle of the respective open portions next to one compact portion and a tension was intermittently applied to the yarn by intermittently pulling it by hand at portions fairly distant from and outside the needles. The interlacement in said one compact portion between the needles remained. The interlacement in one of the compact portions next to said one compact portion also remained, but the interlacement in the other compact portions on the same side of said one compact portion was released and the filaments were opened. The interlacement in the other compact portion next to said one compact portion as well as in other compact portions on the same side of said other compact portion was released, whereby the compactness of these portions disappeared.

The needles were removed from the yarn and a tension was again intermittently applied to the yarn, whereupon the interlacement in said one and said other compact portions was released and the filaments were opened.

The textured yarn of this Example had a configuration of interlacement as shown in FIG. 4.

EXAMPLE 2

A multifilament yarn of 150 denier/48 filaments having a twist of 18 turns/meter was prepared by melt spinning polyethylene terephthalate into filaments and drawing them. The multifilament yarn was then processed in a manner as illustrated in FIG. 11. That is, the yarn Y was false twisted at a processing rate of 150 m/min and then interlaced with an air stream.

The obtained textures yarn had an appearance as shown in FIG. 1. Two needles were pierced into the middle of the respective open portions next to one compact portion and a tension was intermittently applied to the yarn by intermittently pulling it by hand at portions fairly distant from and outside the needles. The interlacement in said one compact portion between the needles was released whereby the compactness of the portion disappeared. The interlacement in the two compact portions next to said one contact portion remained due to the presence of the needles in the two open portions between said one compact portion and the two compact portions next to said one compact portion.

The textured yarn of this Example had a configuration of interlacement as shown in FIG. 3.

In this example, a crimped textured multifilament yarn, which is provided with a heat-treatment under relaxed condition after the false twisting treatment, is utilized, instead of the above-mentioned false twisted multifilament yarn. It was observed that, the number of the interlaced portions of such treated yarn is decreased and particularly the number of the interlaced portion shown in FIG. 3 is reduced, in comparison with the above-mentioned case.

EXAMPLE 3

A multifilamentary yarn of 250 denier/48 filament, as used in Example 1, was processed as illustrated in FIG. 11. That is, the yarn Y was drawn into 150 denier and false twisted, and then interlaced with a fluid at a processing rate of 150 m/min.

The obtained textured yarn had an appearance as shown in FIG. 1. Two needles were pierced into the middle of the respective open portions next to one compact portion and a tension was intermittently applied to the yarn by intermittently pulling it by hand at portions fairly distant from and outside the needles. The interlacement in said one compact portion between the needles remained. The interlacement in a half length of each of the compact portions next to said one compact portion was released. The interlacement in the other compact portions outside said next compact portions was released and the filaments were opened.

One of the two needles was removed from the yarn and a tension was again intermittently applied to the yarn, whereupon the interlacement in a half length of said one compact portion was released on the side where the needle was removed. When the other needle was also removed and a tension was further intermittently applied to the yarn, the interlacement in said one compact portion was completely released whereby the compactness of the portion disappeared.

The textured yarn of this Example had a configuration of interlacement as shown in FIG. 5.

EXAMPLE 4

Polyethylene terephthalate was melt spun into filaments at a take up rate of 3000 m/min to obtain a package of multifilament yarn of 255 denier/48 filaments. The multifilament yarn was unwound from the yarn package and then processed as illustrated in FIG. 11. That is the unwound yarn Y was drawn at a draw ratio of 1.7 and simultaneously false twisted between delivery means 28 and 31. Subsequently, the yarn was interlaced between delivery means 31 and 33 under the following conditions.

Rate of the yarn; 200 m/min
Tension of the yarn; 7 g
Consumption of fluid (air) through the fluid jet device; 33 N.l/min The obtained yarn could be woven into a fabric of double width and 500 meter length on a water jet loom without any trouble. The fabric had good dignity with no defect such as streaks and was bulky.

EXAMPLE 5

Figure 30:
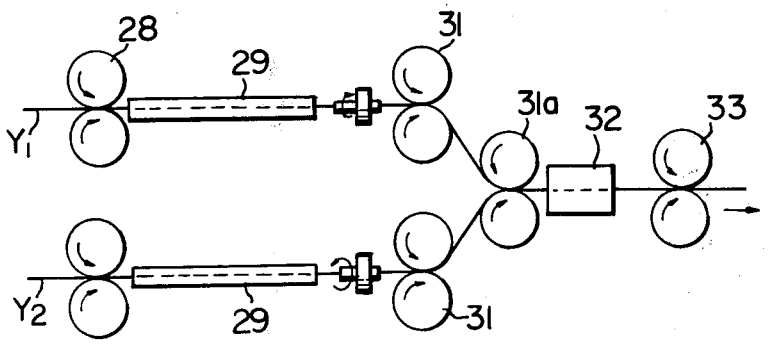
FIG. 30 is a schematic elevation of an interlacing treating apparatus disposed at a position downstream of a pair of false twisting processes, for applying the interlacing treatment to two false twisted multifilament yarns delivered from said two false twisting processes, according to the present invention.

In a manner as illustrated in FIG. 30, two nylon multifilament yarns of 70 denier/24 filaments, which were false twisted in S- and Z-directions respectively on two false-twisting units arranged in a row, were doubled and interlaced according to the invention. The textured yarn so obtained was fairly cohesive as in a yarn consisting of a single multifilament strand. The yarn was formed into a hank, dyed and taken up into a cheese. The yarn could be easily woven into a fabric.

In FIG. 30, $Y_1$ and $Y_2$ designate material yarns to be fed and 31*a* designates a pair of rollers for doubling two false twisted yarns.

EXAMPLE 6

Using an interlacing device as shown in FIG. 12, at the inlet and outlet side portions of which two guide members made of a substrate based on titanium and having a curvature radius of 2 mm were arranged at an interval of 90 mm, a polyester multifilament yarn of 50 denier/18 filaments was interlaced at a processing rate of 600 m/min under a tension of 3 g. The yarn processed was contacted with and bended by, at an angle of 90°, the ring members.

Thus, an interlaced multifilament yarn having a desired configuration of interlacement was obtained.

EXAMPLE 7

The following interlacing treatment was carried out using an interlacing device as shown in FIG. 10, wherein hard wearing bushes 50*a* and 50*b* were attached to the inlet and outlet of the yarn passage 34*a* of a tubular member 34, and according to the first embodiment illustrated in FIGS. 7 and 8, in such a manner that the yarn Y was passed through the bending points P and Q. That is, a polyester multifilament yarn of 150 denier/48 filaments was false twisted and subsequently interlaced, at a processing speed of 400 m/min, under a tension of 7 g, in a manner as illustrated in FIG. 11, wherein the yarn was contacted with and bent by, at an angle of 30°, two guide members made of alumina having a curvature radius of 3 mm and arranged at an interval of 30 mm.

Thus, an interlaced multifilament yarn having a desired configuration of interlacement was obtained.

EXAMPLE 8

In a manner as illustrated in FIG. 30, two nylon multifilament yarns of 70 denier/24 filaments, which were false twisted in S- and Z-directions respectively, were doubled and interlaced at a processing rate of 300 m/min, under a tension of 6 g, using an interlacing device as shown in FIG. 12. The doubled yarns were contacted with, at a contact angle of 30°, two guide members made of alumina having a curvature radius of 3 mm and arranged at an interval of 26 mm.

The obtained interlaced multifilament yarn had a desired configuration of interlacement.

EXAMPLE 9

Figure 21:
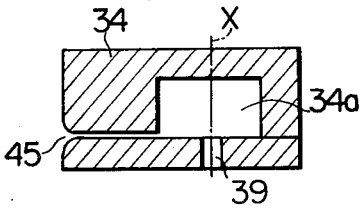

Each of cuprammonium rayon multifilament yarns of 100 denier/28 filaments and 110 denier/28 filaments, acetate rayon multifilament yarns of 100 denier/28 filaments, 110 denier/28 filaments and 70 denier/20 filaments, acrylic multifilament yarns of 150 denier/50 filaments, 100 denier/42 filaments and 70 denier/26 filaments, nylon multifilament yarns of 70 denier/24 filaments, 50 denier/17 filaments, 100 denier/48 filaments and 110 denier/30 filaments, and polyester multifilament yarns of 50 denier/18 filaments, 50 denier/24 filaments, 75 denier/36 filaments and 75 denier/24 filaments, was subjected to an interlacing treatment using an interlacing device as shown in FIG. 21. The interlacing device used had a yarn passage 34*a* of a rectangular cross section of 2.5mm × 1.1mm and a length of 20 mm. The diameter of the fluid inlet passage 39 was 0.6 mm, the distance between the guide members 42*a* and 42*b* was 82 mm and the slit for threading the yarn Y was 0.08 mm. The interlacing treatment was carried out with a compressed air of 4.5 kg/cm$^2$, at a processing rate of 500 m/min, under a tension of 0.05 g/denier.

The interlaced yarns so obtained were examined and compared with each other. The results showed that the yarns had compact portions of 20 to 90 per meter and that a multifilament yarn with a small number of filaments had a small number of compact portions, while a yarn with a large number of filament had a large number of compact portions. In these yarns the percentage of compact portions having an interlacement configuration as shown in FIG. 4 or 5 was 82% or more of the total number compact portions. The examination was carried out by extracting 100 compact portions at random from 100 m of each interlaced yarn.

EXAMPLE 10

The following test was carried out in order to examine the influence of tension in the interlacing treatment according to the invention.

A nylon multifilament yarn of 1350 denier/68 filaments was interlaced using an interlacing device as shown in FIG. 10. The diameter of the yarn passage of the device was 4 mm, the diameter of the air inlet passage was 0.9 mm and the distance between the guide members was 42 mm. The interlacing treatment was carried out with a compressed air of 5 kg/cm, at a processing rate of 200 m/min, under a tension of 0.02 g/denier or 0.04 g/denier.

The results showed that the interlaced yarn obtained under a tension of 0.02 g/denier had 39 compact portions per meter wherein compact portions having the interlacement configuration as shown in FIG. 4 or 5 existed in an amount of 76/100 of the total compact portions, while the interlaced yarn obtained under a tension of 0.04 g/denier had 27 compact portions/meter wherein compact portions having the interlacement configuration as shown in FIG. 4 or 5 existed in an amount of 85/100 of the total compact portions.

EXAMPLE 11

Figure 20:
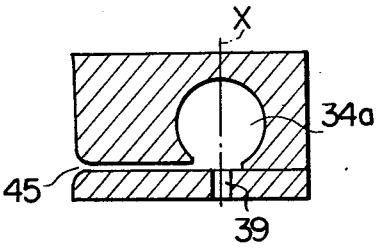

Polyethylene terephthalate was melt spun and taken up at a rate of 3000 m/min to prepare a multifilament yarn of 250 denier/30 filaments. Between the delivery means and take up means of the spinning machine an interlacing fluid jet device according to the invention, as shown in FIG. 20, was provided and, thereby, said polyethylene terephthalate multifilament yarn was interlaced. The diameter of the yarn passage 34*a* of the interlacing device was 1.5 mm and the length was 12 mm, the diameter of the fluid inlet passage 39 was 0.8 mm, the slit 45 for threading the yarn was 0.15 mm, and the distance between the guide members 40*a* and 40*b* was 50 mm. The interlacing treatment was carried out with a compressed air of 4 kg/cm$^2$, under a tension of 0.12 g/denier.

The obtained interlaced multifilament yarn had 6.4 compact portions per meter wherein the ratio of the number compact portions having the interlacement configuration as shown in FIG. 4 or 5 to the total number of compact portions was 96:100.

This Example shows that the interlacing treatment according to the invention was advantageously applied to an undrawn multifilament yarn.

EXAMPLE 12

Tests for the interlacing treatment according to the invention in combination with various types of conventional texturing treatments were carried out using a polyester multifilament yarn of 150 denier/48 filaments in a manner as described below.

The yarn was treated by each of the following texturing treatments: a false twisting at a heater temperature of 220° C while imparting twists of 2480 turns/meter; an edge crimping on a known edge crimping machine immediately after heating at 220° C, a stuffer crimping on a known stuffer box system; a gear crimping using a pair of gears of M. 1.0, and; knitting — deknitting wherein a plain stitch fabric knitted on a circular plain knitting machine was heat-treated at 160° C for 1 minute and then deknitted.

Figure 22:
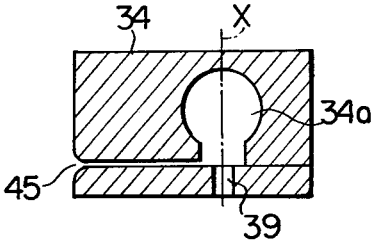

Each of the textured yarns thus obtained was subjected to an interlacing treatment using an interlacing air jet device as shown in FIG. 22. The circular portion of the cross section of the yarn passage 34*a* of the interlacing device had a diameter of 1.5 mm, the rectangular portion of the cross section measured 1mm × 1mm and the length of the yarn passage was 8 mm. The diameter of the fluid inlet passage 39 was 0.8 mm. The interlacing treatment was carried out with a compressed air of 3.5 kg/cm$^2$, at a processing rate of 200 m/min, under a tension of 0.025 g/denier.

The configurations of the interlaced yarns thus obtained are shown in Table 1 below. From the results, it is apparent that the combination of the interlacing treatment according to the invention with the false twisting gives the best interlacement.

Table 1

| Advanced texturing | Number of interlaced portions /m | Number of interlaced portions having the interlaced configurations shown in FIG. 4 or FIG. 5 per a total number of 100 interlaced portions ( /100) |
|---|---|---|
| False-twisting | 120 | 72 |
| Edge crimping | 67 | 57 |
| Stuffer crimping | 69 | 67 |
| Gear crimping | 41 | 71 |
| Knitting and deknitting | 40 | 72 |

EXAMPLE 13

Two types of multifilament yarns made of different substrates or subjected to different advanced treatments, or made of different substrates and subjected to different advanced treatments, were doubled or simultaneously spun together and then subjected to the interlacing treatment according to the invention using the same interlacing air jet device as used in Example 9.

The obtained yarns were confirmed to have the configurations of interlacement according to the invention.

The combinations of the two material yarns are shown in Table 2 below.

Table 2

| Test No. | Combination of the material yarns |
|---|---|
| 1 | Polyester multifilament yarn 75d/24f<br>(a) (stuffer crimpig)<br>(b) (false twisting) |
| 2 | Polyester multifilament yarn 150d/48f<br>(a) (false twist treatment 2450 turn/m)<br>(b) (false twisting 2000 turn/m) |
| 3 | Nylon multifilament yarn 70d/36f<br>(a) (False twising in S direction)<br>(b) (false twisting in Z direction) |
| 4 | (a) Polyester multifilament yarn 40d/20f<br>(b) Acetate multifilament yarn 35d/18f |
| 5 | Polyester multifilament yarn 50d/24f<br>(a) (shrinking property in the boiling water 15%)<br>(b) (shrinking property in the boiling water 7%) |
| 6 | Polyester multifilament yarn 50d/24f<br>(a) (each individual filament is provided with a circular cross section)<br>(b) (each individual filament is provided with a triangular cross section) |
| 7 | Polyester multifilament yarn 75d/36f<br>(a) (normal yarn)<br>(b) (cation-dyeable yarn) |
| 8 | Polyester multifilament yarn 75d/36f<br>(a) (containing 0.5% $TiO_2$)<br>(b) (containing 2.5% carbon black) |
| 9 | Polyester multifilament yarn 75d/36f<br>(a) (normal tenacity)<br>(b) (low tenacity) |
| 10 | (a) Nylon 6 multifilament yarn 50d/24f<br>(b) Nylon 66 multifilament yarn 100d/48f |
| 11 | (a) Polyester multifilament yarn 150d/48f (normal)<br>(b) Polyester multifilament yarn 40d/20f (having lower melting point than the material yarn (a) |
| 12 | (a) Undrawn polyester multifilament yarn of 26 filaments (thickness of each filament 3.1d)<br>(b) Undrawn polyester multifilament yarn of 26 filaments (thickness of each filament 4.7d)<br>(c) Undrawn polyester multifilament yarn of 20 filaments (thickness of each filament 7.8d)<br>(NOTE) The above-mentioned three multifilament yarns (a) (b) and (c) are simultaneously spun by means of a single spinneret in parallel condition and subjected to an in-draw false twisting treatment at a speed of 350 m/min. The total thickness of the combined material yarn was 360 denier and that of the product was 235d. |
| 13 | (a) Polyester multifilament yarn 150d/48f (false twisted)<br>(b) Polyuretan yarn 70d (3 times streched)<br>(NOTE) The false twising treatment and the interlacing treatment of the yarn (a) is processed continuously. The yarn (b) is combined with the yarn (a) at a position downstream of the false twisting treatment of the yarn (a). |
| | (a) Polyester multifilament yarn 75d/36f<br>(b) Polyester multifilamet yarn 150d/48f<br>(NOTE) The yarns (a), (b) are combined at a position upstream the false-twisting treatment. The yarn (b) is 17% over feed in comparison with that of the yarn (a). |

What is claimed is:

1. A multifilament yarn comprising a bundle of filaments, said yarn being composed of compact portions where the filaments are interlaced and open portions where the filaments are not substantially interlaced, said compact portions and open portions appearing alternately along the length of said yarn, each of at least 50% of said compact portions having a configuration of interlacement such that, when a compact portion is subjected to an interlacement releasing action together with the compact portions next to said compact portion, the interlacement of filaments in said compact portion cannot be released alone within said portion but it can be released together with at least a part of the interlacement of filaments in one compact portion next to said compact portion, while it cannot be released together with the interlacement of filaments in the other compact portion next to said compact portion.

2. A multifilament yarn in accordance with claim 1 wherein the filaments are undrawn filaments.

3. A multifilament yarn in accordance with claim 1 wherein the filaments are crimped filaments.

4. A multifilament yarn in accordance with claim 3 wherein the crimps of the filaments are not uniform with respect to their shape, size and properties.

5. A multifilament yarn in accordance with claim 1 wherein the yarn is composed of at least two kinds of filaments.

* * * * *